US009427975B2

(12) United States Patent
Bugner et al.

(10) Patent No.: US 9,427,975 B2
(45) Date of Patent: Aug. 30, 2016

(54) AQUEOUS INK DURABILITY DEPOSITED ON SUBSTRATE

(71) Applicants: Douglas Eugene Bugner, Rochester, NY (US); David D. Putnam, Fairport, NY (US); Hwei-Ling Yau, Rochester, NY (US); Thomas Joseph Dannhauser, Pittsford, NY (US); Brian L Lindstrom, Victor, NY (US)

(72) Inventors: Douglas Eugene Bugner, Rochester, NY (US); David D. Putnam, Fairport, NY (US); Hwei-Ling Yau, Rochester, NY (US); Thomas Joseph Dannhauser, Pittsford, NY (US); Brian L Lindstrom, Victor, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 83 days.

(21) Appl. No.: 14/302,866

(22) Filed: Jun. 12, 2014

(65) Prior Publication Data

US 2015/0360480 A1 Dec. 17, 2015

(51) Int. Cl.

| | |
|---|---|
| ***B41J 2/21*** | (2006.01) |
| ***B41J 11/00*** | (2006.01) |
| ***B41M 7/00*** | (2006.01) |
| ***B41J 2/01*** | (2006.01) |
| *B41M 5/52* | (2006.01) |

(52) U.S. Cl.

CPC ..... *B41J 11/0015* (2013.01); *B41J 2/01* (2013.01); *B41J 2/2107* (2013.01); *B41J 2/2114* (2013.01); *B41M 7/00* (2013.01); *B41M 7/009* (2013.01); *B41M 5/5218* (2013.01); *B41M 7/0018* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; B41J 2/0057; B41J 3/60; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/95–105

See application file for complete search history.

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,296,421 | A | 10/1981 | Hara et al. |
| 5,026,427 | A | 6/1991 | Mitchell et al. |

(Continued)

FOREIGN PATENT DOCUMENTS

| | | |
|---|---|---|
| JP | 2002-187264 | 7/2002 |
| WO | 8807103 | 9/1988 |
| WO | 2013/165882 | 11/2013 |

*Primary Examiner* — Manish S Shah

(74) *Attorney, Agent, or Firm* — Raymond L. Owens; J. Lanny Tucker

(57) ABSTRACT

A method for improving durability of aqueous ink deposited on a substrate having multivalent metal salt present at the surface of the substrate is disclosed. The method includes depositing aqueous ink on the surface of the substrate, wherein the aqueous ink is an anionically stabilized pigment ink, drying the substrate to substantially remove the water from the deposited aqueous ink, applying substantially pure water and heat to the dried substrate with deposited aqueous ink, and removing the applied water and heat to return the dried substrate to an ambient temperature and moisture content. The applied substantially pure water and heat are sufficient to cause a significant improvement of the durability of the deposited ink on the substrate.

18 Claims, 1 Drawing Sheet

(56) References Cited

U.S. PATENT DOCUMENTS

| | | | |
|---|---|---|---|
| 5,086,698 | A | 2/1992 | Wirz |
| 5,092,059 | A | 3/1992 | Wimberger et al. |
| 5,141,556 | A | 8/1992 | Matrick |
| 5,160,370 | A | 11/1992 | Suga et al. |
| 5,169,436 | A | 12/1992 | Matrick |
| 5,244,861 | A | 9/1993 | Campbell et al. |
| 5,261,166 | A | 11/1993 | Seeley et al. |
| 5,651,813 | A | 7/1997 | Santilli et al. |
| 5,679,138 | A | 10/1997 | Bishop et al. |
| 5,853,965 | A | 12/1998 | Haydock et al. |
| 5,866,282 | A | 2/1999 | Bourdelais et al. |
| 5,874,205 | A | 2/1999 | Bourdelais et al. |
| 5,888,643 | A | 3/1999 | Aylward et al. |
| 5,888,681 | A | 3/1999 | Gula et al. |
| 5,888,683 | A | 3/1999 | Gula et al. |
| 5,888,714 | A | 3/1999 | Bourdelais et al. |
| 5,985,017 | A | 11/1999 | Bugner et al. |
| 6,058,621 | A | 5/2000 | Piccinino, Jr. et al. |
| 6,088,930 | A | 7/2000 | Robin et al. |
| 6,412,190 | B1 | 7/2002 | Smith |
| 6,517,197 | B2 | 2/2003 | Hawkins et al. |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,682,182 | B2 | 1/2004 | Jeanmaire et al. |
| 6,793,328 | B2 | 9/2004 | Jeanmaire |
| 6,866,370 | B2 | 3/2005 | Jeanmaire |
| 7,820,991 | B2 | 10/2010 | Bar et al. |
| 8,173,215 | B2 | 5/2012 | Sowinski et al. |
| 8,398,191 | B2 | 3/2013 | Cook et al. |
| 8,419,176 | B2 | 4/2013 | Dockery et al. |
| 8,434,857 | B2 | 5/2013 | Falkner et al. |
| 8,562,126 | B1 | 10/2013 | Xiang et al. |
| 2006/0012654 | A1 | 1/2006 | Wang et al. |
| 2007/0043144 | A1 | 2/2007 | House et al. |
| 2007/0222811 | A1* | 9/2007 | Yanagi ..... B41J 2/2114 347/96 |
| 2009/0031579 | A1 | 2/2009 | Piatt et al. |
| 2011/0050789 | A1* | 3/2011 | Irita ..... C08L 71/02 347/21 |
| 2011/0123714 | A1 | 5/2011 | Yau et al. |
| 2011/0279554 | A1* | 11/2011 | Dannhauser ..... B41M 5/52 347/106 |
| 2011/0303113 | A1 | 12/2011 | Sarkisian et al. |
| 2012/0274685 | A1 | 11/2012 | Mis et al. |

* cited by examiner

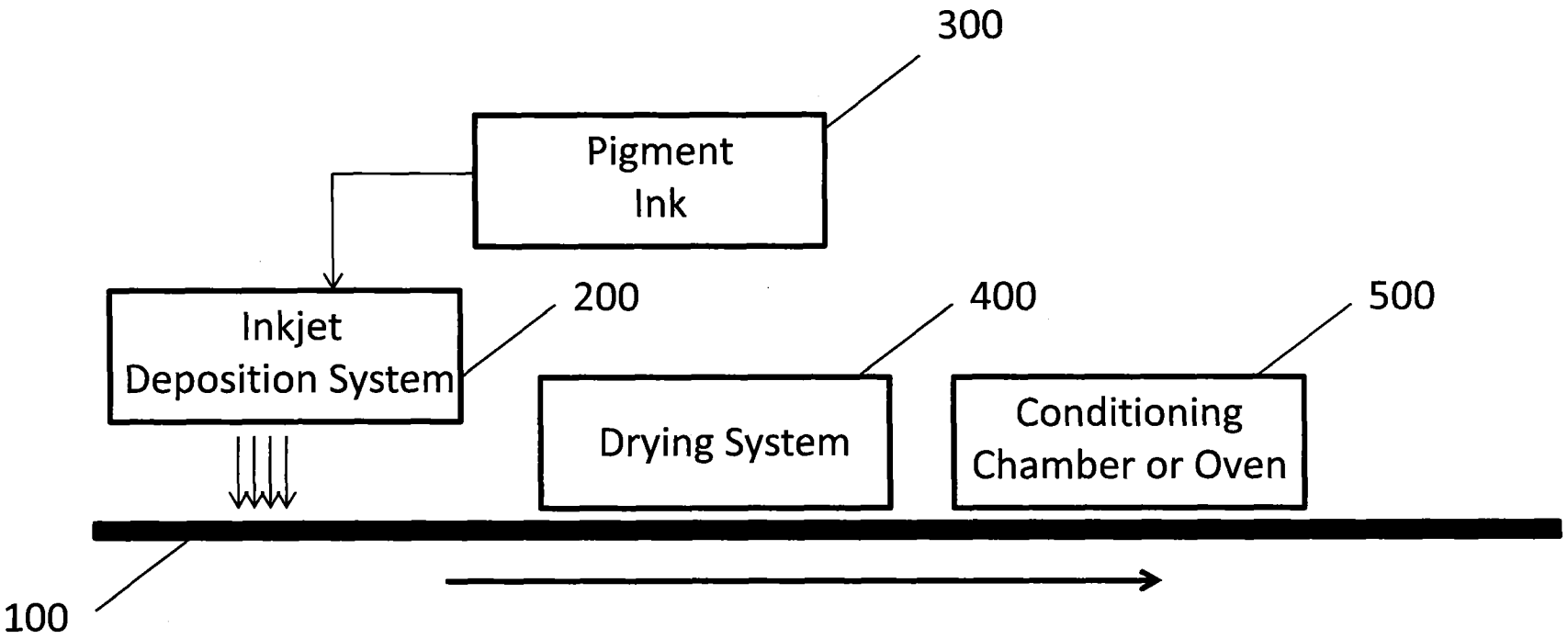
300
Pigment Ink
200
Inkjet Deposition System
400
Drying System
500
Conditioning Chamber or Oven
100

AQUEOUS INK DURABILITY DEPOSITED ON SUBSTRATE

FIELD OF THE INVENTION

The present invention relates to applying aqueous ink on a substrate having multivalent salt on the surface, and more particularly to improving the durability of the dried deposited ink.

BACKGROUND OF THE INVENTION

It is well known to deposit aqueous inks, particularly those having anionically stabilized pigments on a substrate having multivalent metal salt on the surface of the substrate in order to prevent the ink drops from either penetrating too far below the surface of a substrate such as an uncoated paper, thereby resulting in a lowering of optical density, or from bleeding or coalescing of adjacent ink drops of the same or different colors on a less absorbent substrate, thereby resulting in blurry or grainy appearing images. Surface treatments comprising multivalent metal ions are particularly advantageous for high speed printing with page-wide ink jet arrays, wherein adjacent drops of ink are deposited within just a few microseconds of each other onto the substrate.

Dannhauser, et al. (US 2011/0279554), describe an inkjet receiving medium suitable for high speed inkjet printing which includes a substrate having a topmost layer coated thereon comprising an aqueous soluble salt of a multivalent metal cation and a cross-linked hydrophilic polymer binder.

Xiang and Botros (U.S. Pat. No. 8,562,126 B1) describe an inkjet receiving medium comprising a substrate and having a topmost layer coated thereon, wherein the topmost layer includes one or more aqueous soluble salts of multivalent metal cations, a cationic polyelectrolyte comprising amidine moieties, and a second polymer which is distinct from the cationic polyelectrolyte comprising amidine moieties and which is selected from the group including a polyamide-epichlorohydrin, a polyamine solution polymer, and a waterborne or water-dispersible polyurethane. Although images printed on substrates with these types of surface treatments display excellent image quality and adequate durability for many applications, it has been found that immediately after printing and for some time thereafter, the printed inks can still be susceptible to smudging or offsetting.

In an attempt to address these issues, Dannhauser, et al., (WO2013/165882), disclose adding particles comprised primarily of a polymer having a Rockwell Hardness of less than R90 and having a mode equivalent spherical diameter of at least about 2 micrometers to coating compositions comprising one or more aqueous soluble salts of multivalent metal cations.

Other approaches to improving the durability of printed substrates involve the application of a protective post-coating, such as a varnish or laminate. For example, Sarkisian, et al., (US 2011/0303113 A1) disclose the application of overprint varnishes to substrates having multivalent metal salts that have been printed with anionically stabilized pigment inks before application of the varnish. These varnishes are claimed to protect the inks from wet or dry abrasion. However, there is no mention of the impact of the varnish on the durability of the ink layer itself, e.g., ink cohesion or ink adhesion to the substrate. Another obvious drawback of this approach is that it can add substantial cost and complexity to the process and the printed article.

Although these coatings are improved in certain aspects of durability, the need remains for more durable digital prints to overcome the effects of handling in production and in use by the consumer. In particular, there is a need to improve the physical durability of the printed ink on the substrate as soon as possible after drying and exiting the printing press. There is also the need to improve the adhesion of laminates or other types of overcoats applied shortly after printing.

It has been observed that aqueous inks comprising anionically stabilized pigments deposited on a substrate having a multivalent salt on the surface exhibit relatively poor durability immediately after drying, but they generally increase in durability with aging over an extended period of time. Although ambient aging does result in increased durability, the results are inconsistent and unpredictable due to variations in the ambient conditions. Furthermore, to attain adequate levels of durability for many applications, the time required under ambient conditions is unacceptably long. Thus there is a need to accelerate the aging process such that much improved print durability is achieved as soon as possible after printing and drying.

SUMMARY OF THE INVENTION

It has been found quite unexpectedly, that by the appropriate application of substantially pure water and heat to a dried aqueous ink comprising anionically stabilized pigment particles that has been deposited onto a substrate with multivalent salt on the surface of the substrate, there is a significant, immediate, and unexpected improvement in the durability of the dried ink.

In accordance with the present invention, there is provided a method for improving the durability of a dried aqueous ink comprising anionically stabilized pigment particles that has been deposited on a substrate having multivalent metal salt present at the surface of the substrate, comprising:

depositing aqueous ink on the surface of the substrate, wherein the aqueous ink is an anionically stabilized pigment ink;

drying the substrate to substantially remove the water from the deposited aqueous ink;

applying substantially pure water and heat to the dried substrate with deposited aqueous ink; and removing the applied water and heat to return the dried substrate to an ambient temperature and moisture content, the applied substantially pure water and heat being sufficient to cause a significant improvement of the durability of the deposited ink on the substrate.

The present invention is accomplished by using various different techniques such as having a conditioning chamber or a temperature and humidity controlled oven wherein substantially pure water and heat are applied to the dried ink on the substrate. The chamber or oven can ideally be in-line with the printing process so that the benefit of the increased durability is achieved prior to the next step in the process. Alternately, the printed sheets or rolls are placed in a chamber or oven at elevated temperature and humidity in a separate step.

In a preferred embodiment, the substantially pure water and heat are applied simultaneously. Although the upper limits to the effective amounts of water and heat are not known, the use of a steam chamber or "steam foil", which can achieve temperatures near 100° C. at essentially 100% relative humidity, is an especially preferred embodiment for accelerating the increase in durability of the dried deposited ink.

Another preferred embodiment involves re-moisturizing the dried, printed substrate with a uniform layer of liquid water followed by immediate re-drying of the substrate. The uniform layer of liquid water need not contain any additional binders or other durability enhancing additives as might be found in an aqueous varnish. By "substantially pure water" it is meant that it is greater than 90% by weight pure water, preferably greater than 95% by weight. The water layer can contain the usual small amounts of coating aids, such as surfactants, biocides, pH adjustors, conductivity modifiers, rheology modifiers, and the like.

It is preferred that, following the application of the moisture and heat, the printed substrate is brought back to an equilibrium ambient temperature and moisture content prior to further processing.

Additional processes can also be applied to the dried printed substrate subsequent to the application of heat and moisture as described above. Included in such processes are a fusing step, wherein the dried, printed, and conditioned substrate is passed through a pair of rollers at elevated pressures and optionally elevated temperatures. Another process that can be included is the application of an electric field across the substrate in such a way that forces the multivalent metal ions away from the surface of the dried, printed substrate.

BRIEF DESCRIPTION OF THE DRAWINGS

FIG. 1 is a schematic of a system for practicing the present invention.

DETAILED DESCRIPTION OF THE INVENTION

Inkjet receiving media in accordance with the invention comprise a substrate 100 with a topmost layer comprising a multivalent metal salt. In one particular embodiment, the topmost layer is applied at a dry coverage of from 0.1 to 25 $g/m^2$, wherein the topmost layer includes from 30-70 wt % of one or more aqueous soluble salts of multivalent metal cations and at least 0.05 $g/m^2$ of a cross-linked hydrophilic polymer binder. Although the topmost layer of the receiving medium of the invention is believed to improve the inkjet printing performance on a wide variety of substrates, in a particular embodiment of the invention the substrate 100 is one of a glossy, semi-glossy or matte coated lithographic offset paper. Although such coated offset papers are designed for printing primarily with non-aqueous solvent-based inks, providing a topmost layer in accordance with the present invention over such coated offset papers has been found to enable inkjet printing with high image quality including reduced grain and mottle and increased optical density.

Lithographic coated offset papers typically comprise a paper base which has been coated with clay or the like and undergone surface calendering treatment to provide a desired surface smoothness. The invention applies to the use of both glossy and matte coated offset papers and any grade in between glossy and matte. Such coated offset papers employable as the substrate 100 of the inkjet receiving medium of the invention are obtained from various commercial paper manufacturers, including, e.g., International Paper, Sappi, New Page, Appleton Coated, Abitibi-Bowater, Mohawk Papers, Verso, Mitsubishi, Norpac, Domtar, and many others. Specific examples include, e.g., STERLING ULTRA GLOSS paper (80 lb basis weight), a coated glossy offset paper for lithographic printing manufactured by NewPage, and UTOPIA BOOK (45 lb. basis weight), available from Appleton Coated, a coated matte offset paper.

In various embodiments, the substrate 100 is readily hydrophilic and capable of adsorbing and transferring ink colorant to the substrate interior prior to being coated thereon with the topmost layer of the invention, such as wherein the substrate 100 is porous. Alternatively, the substrate 100 can be substantially impermeable to water or aqueous ink, such as a non-porous plastic film. In a particular preferred embodiment, the invention is particularly useful wherein the substrate 100 includes a relatively hydrophobic coated surface prior to being coated thereon with the topmost layer, and the topmost layer provides a continuous relatively hydrophilic surface.

Although the invention is in certain embodiments directed towards the use of coated offset papers as the substrate 100, the topmost layer of the invention can also be used in combination with uncoated offset paper or other plain papers, including cardboards or carton stocks useful in packaging applications. In the case of uncoated papers or carton stocks, the aqueous soluble salts of multivalent metal cations are incorporated into the surface of the paper by a size press or other conventional process in-line with paper making, and need not be a discrete surface layer.

Further, the invention can also be used with any of those supports typically used for inkjet receivers, such as resin-coated paper, polyesters, or microporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. The kind of paper supports listed above include a wide range of papers, from high end papers, such as photographic paper to low end papers, such as the kind used for newsprint. In a preferred embodiment, commercial offset-grade coated paper is used Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base.

Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof.

The topmost coating composition is applied to both sides of the substrate 100, or alternatively to only one side. The method employed to accomplish this is selected from a number of known techniques, including but not limited to spraying, rod coating, blade coating, gravure coating (direct, reverse, and offset), flexographic coating, size press (puddle and metered), extrusion hopper coating, and curtain-coating. After drying, the resulting topmost layer is optionally calendared to improve gloss.

In one embodiment, the topmost layer is applied in line as part of the substrate manufacturing process. In another embodiment, the topmost layer is coated as a separate coating step subsequent to the manufacture of the paper (or other substrate 100 as described above). In a particular embodiment, the topmost layer is applied in-line as part of the printing operation, wherein such layer is applied to a substrate 100 in a pre-coating station prior to printing. Such in-line application can be performed by the various coating processes identified above, or alternatively by a printhead positioned in-line with the ink-applying printheads. When a printhead is used to apply the coating solution, the option exists of covering only the printed image area with the coating material, rather than the entire area of the substrate 100. Pre-coat application provides the advantage of preventing color-to-color bleed during imaging, since the colorants of the pigment ink 300 are immobilized instantaneously as the pigment ink 300 contacts the pre-coated substrate 100. Furthermore, with pre-coating, images appear darker and have sharper edge definition, since the coating reduces pigment ink 300 colorant penetration and permits more fixed colorant on the surface. Finally, although the pre-coat material can optionally be dried completely before image printing, complete drying of the pre-coated substrate 100 is not necessary. Therefore, drying can alternatively be applied once after imaging, resulting in considerable savings in energy.

The topmost layer of the inkjet receiving medium of the invention includes a water-soluble salt of a multivalent metal. Water-soluble is herein defined as at least 0.5 g of the salt capable of dissolving in 100 ml water at 20° C. The salt is preferably essentially colorless and non-reactive. More preferably, the multivalent metal is a cation selected from $Mg^{+2}$, $Ca^{+2}$, $Ba^{+2}$, $Zn^{+2}$, and $Al^{+3}$, most preferably $Ca^{+2}$ or $Mg^{+2}$ in combination with suitable counter ions.

Examples of the salt used in the invention include (but are not limited to) calcium chloride, calcium acetate, calcium nitrate, magnesium chloride, magnesium acetate, magnesium nitrate, barium chloride, barium nitrate, zinc chloride, zinc nitrate, aluminum chloride, aluminum hydroxychloride, and aluminum nitrate. Similar salts will be appreciated by the skilled artisan. Particularly preferred salts are calcium chloride, calcium acetate, calcium nitrate, magnesium chloride, magnesium acetate, and magnesium nitrate, including hydrated versions of these salts. Combinations of the salts described above can also be used. The topmost layer preferably includes calcium ion equivalent to at least 0.05 $g/m^2$ of calcium chloride, more preferably equivalent to at least 0.1 $g/m^2$ of calcium chloride.

The topmost layer of the receiving medium can further include a cross-linked hydrophilic polymer binder alone or in combination with one or more additional binders. Such hydrophilic polymer binder includes a polymer capable of adsorbing water, and preferably is capable of forming a continuous phase solution with the multivalent metal salt. Non-exclusive examples of such materials include gelatin, starch, hydroxycelluloses, polyvinyl alcohol, polyvinyl pyrrolidone, polyethylene imine, polyvinyl amine, and derivatives of these materials. A preferred binder is an acetylacetate-modified polyvinyl alcohol obtained under the trade name Gohsefimer Z-320 from Nippon Gohsei. To provide an enhanced level of abrasion resistance and cohesiveness, the topmost layer includes at least 0.05 $g/m^2$ of cross-linked hydrophilic polymer binder. The identity and amount of crosslinker will depend on the choice of polymer and its reactivity with the crosslinker, the number of crosslinking sites available, compatibility with other solution components, and manufacturing constraints such as solution pot life and coating drying speed. Non-exclusive examples of crosslinker materials are glyoxal, Cartabond TSI (Clariant), Cartabond EPI (Clariant), Sequarez 755 (Omnova), glutaraldehyde sodium bisulfate complex (Aldrich), Sunrez 700M (Omnova), Sunrez 700C (Omnova), CR-5L (Esprix), bis(vinyl) sulfone, bis(vinyl) sulfone methyl ether, adipoyl dihydrazide, epichlorohydrin polyamide resins and urea-formaldehyde resins. In a particular embodiment, the cross-linked hydrophilic polymer includes a cross-linked aceto-acetylated polyvinyl alcohol polymer, such as aceto-acetylated polyvinyl alcohol polymer cross-linked with a glyoxal compound.

In accordance with the invention, the topmost layer is coated on the substrate 100 at solid content of from 0.1 to 25 $g/m^2$, preferably from 0.1 to 12 $g/m^2$, more preferably from 0.2 to 8 $g/m^2$, more preferably from 0.2 to 3 $g/m^2$, more preferably from 0.25 to 2 $g/m^2$, and most preferably from 0.3 to 1.5 $g/m^2$, and such layer includes from 30-70 wt % of one or more aqueous soluble salts of multivalent metal cations.

Although use of a multivalent metal salt and hydrophilic cross-linked polymeric binder in a topmost layer in accordance with the above specifications itself has been found to provide advantageous performance, in further embodiments, the topmost layer can further comprise a polymer latex filler such as polyurethane latex, vinylacetate-ethylene copolymer latex, and styrene-acrylic latex polymer dispersions for improved water resistance and image durability. When present, however, the fraction of additional latex filler preferably does not exceed 75% of the total polymer in the topmost layer, to avoid undesired decrease in maximum density and increase in mottle upon printing with pigment inks 300.

The topmost layer coating formulation can further comprise additional optional components, such as inorganic or organic particles, as long as the coating solid lay down and relative concentration requirements of the invention are met. These can include, but are not limited to, kaolin clay, montmorillonite clay, delaminated kaolin clay, calcium carbonate, calcined clay, silica gel, fumed silica, colloidal silica, talc, wollastinite, fumed alumina, colloidal alumina, titanium dioxide, zeolites, or organic polymeric particles such as Dow HS3000NA.

Another aspect of the invention is directed to a method of printing in which the above-described receiver is printed with an inkjet deposition system 200 employing at least one anionically stabilized aqueous pigment ink 300. Preferably, the pigment-based colorants are stabilized using anionic dispersants. Such dispersants are polymeric, containing repeating sub-units, or are monomeric in nature. The printing method can employ a continuous high-speed commercial inkjet deposition system 200, for example, in which the printer applies colored images from at least two different print heads, preferably full-width printheads with respect to the media, in sequence in which the different colored parts of the images are registered.

Inkjet deposition systems 200 useful in the invention comprise a printer, at least one anionically stabilized aqueous pigment ink 300 in accordance with the invention, and a substrate 100 suitable for receiving pigment ink 300 from an inkjet deposition system 200. Inkjet printing is a non-impact method for producing printed images by the deposition of ink droplets in a pixel-by-pixel manner to an image-recording element in response to digital data signals. There are various methods that can be used to control the deposition of ink droplets on the image-recording element to yield the desired printed image. In one process, known as drop-on-demand inkjet, individual ink droplets are projected as needed onto the image-recording element to form the desired printed image. Common methods of controlling the projection of ink droplets in drop-on-demand printing include piezoelectric transducers and thermal bubble formation. Drop-on-demand (DOD) liquid emission devices have been known as ink printing devices in inkjet printing systems for many years. Early devices were based on piezoelectric actuators such as are disclosed in U.S. Pat. Nos. 3,946,398 and 3,747,120. A currently popular form of inkjet printing, thermal inkjet (or "thermal bubble jet"), uses electrically resistive heaters to produce vapor bubbles which cause drop emission, as is discussed in U.S. Pat. No. 4,296,421. In another process, known as continuous inkjet, a continuous stream of droplets is charged and deflected in an image-wise manner onto the surface of the image-recording element, while un-imaged droplets are caught and returned to an ink sump. Continuous inkjet deposition systems 200 are disclosed, e.g., in U.S. Pat. Nos. 6,588,888; 6,554,410; 6,682,182; 6,793,328; 6,866,370; 6,575,566; and 6,517,197. Inkjet deposition systems 200 have found wide applications across markets ranging from desktop document and photographic-quality imaging, to short run printing and industrial labeling. Inkjet printing methods, and related printers, are commercially available and need not be described in detail.

The colorant systems of the pigment ink 300 compositions employed in accordance with one embodiment of the invention can be pigment-based or combinations of dye and pigment. Compositions incorporating pigment are particularly useful. Pigment inks 300 are used because such inks render printed images having higher optical densities and better resistance to light and ozone as compared to printed images made from other types of colorants. A wide variety of organic and inorganic pigments, alone or in combination with additional pigments or dyes, can be in the present invention. Pigments that can be used in the invention include those disclosed in, for example, U.S. Pat. Nos. 5,026,427; 5,086,698; 5,141,556; 5,160,370; and 5,169,436. The exact choice of pigments will depend upon the specific application and performance requirements such as color reproduction and image stability. Especially preferred colorants are anionically stabilized pigments.

Pigments suitable for use in the invention include, but are not limited to, azo pigments, monoazo pigments, di-azo pigments, azo pigment lakes, α-Naphthol pigments, Naphthol AS pigments, benzimidazolone pigments, di-azo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium dioxide, iron oxide, and carbon black. In accordance with one embodiment of the invention, colorants comprising cyan, magenta, or yellow pigments are specifically employed. The pigment particles useful in the invention can have any particle sizes which can be jetted through a print head. Preferably, the pigment particles have a mean particle size of less than about 0.5 micron, more preferably less than about 0.2 micron.

Self-dispersing pigments that are dispersible without the use of a dispersant or surfactant can be used in the invention so long as the charge on the surface is predominantly anionic or negative. Pigments of this type are those that have been subjected to a surface treatment such as oxidation/reduction, acid/base treatment, or functionalization through coupling chemistry.

Pigment inks 300 employing non-self-dispersed pigments that are useful in the invention can be prepared by any method known in the art of inkjet printing. Dispersants suitable for use in the invention in preparing stable pigment dispersions include, but are not limited to, those commonly used in the art of inkjet printing. For aqueous pigment inks 300 particularly useful dispersants include anionic surfactants such as sodium dodecylsulfate, or potassium or sodium oleylmethyltaurate as described in, for example, U.S. Pat. No. 5,679,138, U.S. Pat. No. 5,651,813 or U.S. Pat. No. 5,985,017.

Polymeric dispersants are also known and useful in aqueous pigment inks 300. Polymeric dispersants include polymers such as homopolymers and copolymers; anionic, cationic or nonionic polymers; or random, block, branched or graft polymers. The copolymers are designed to act as dispersants for the pigment by virtue of the arrangement and proportions of hydrophobic and hydrophilic monomers. The pigment particles are colloidally stabilized by the dispersant and are referred to as polymer stabilized pigment dispersions. Polymer stabilized pigment dispersions have the additional advantage of offering image durability once the pigment inks 300 are dried down on the substrate 100.

Preferred copolymer dispersants are those where the hydrophilic monomer is selected from carboxylated monomers. Preferred polymeric dispersants are copolymers prepared from at least one hydrophilic monomer that is an acrylic acid or methacrylic acid monomer, or combinations thereof. Preferably, the hydrophilic monomer is methacrylic acid. Particularly useful polymeric pigment dispersants are further described in US 2006/0012654 A1 and US 2007/0043144 A1, the disclosures of which are incorporated herein by reference.

Polymeric dispersed pigment inks 300 suitable for use in particular embodiments of the present invention include those described, e.g., in co-pending, commonly assigned US 2011/0123714 A1, U.S. Pat. No. 8,398,191 B2, U.S. Pat. No. 8,419,176 B2, and U.S. Pat. No. 8,173,215 B2, the disclosures of which are incorporated by reference herein in their entireties.

Pigment inks 300 printed onto inkjet receiving media in accordance with the invention can contain further addenda as is conventional in the inkjet printing art. Particularly preferred addenda for applications requiring enhanced durability are aqueous dispersible acrylic latex polymers and aqueous dispersible or aqueous soluble polyurethane polymers of the types described in US 2012/0274685 A1, and incorporated herein by reference. Particularly preferred polymeric addenda are polyurethanes of the types disclosed in U.S. Pat. No. 8,434,857 B2, which are incorporated herein by reference.

In accordance with an embodiment of the invention, after the anionically stabilized aqueous pigment inks 300 are deposited with an inkjet deposition system 200 on a substrate 100 having multivalent salts present at the surface, the deposited pigment ink 300 is dried by using a drying system 400. For the purpose of this invention, drying means the removal of the water from the deposited aqueous pigment ink 300 to a point where the pigment ink 300 no longer tracks off on any downstream facing rollers. The removal of the water can be by evaporation, absorption into the substrate 100, or a combination of both. When printing at high speeds, rapid evaporative drying, enhanced by application of heat energy and forced air flow across the surface of the print, is preferred. The application of heat energy is accomplished by any number of methods, including but not limited to, heated air, infrared radiation, microwave radiation, acoustic radiation, electrical induction, or combinations thereof. A particularly preferred method of applying heat energy is by employing lamps that emit infrared radiation. Useful drying systems 400 can include components such as described in U.S. Pat. Nos. 5,261,166, 6,412,190, 6,088,930, 6,058,621, and 5,092,059, and further in US 2009/0031579 and WO 88/07103, the disclosures of which are incorporated herein by reference. In a near-IR drying system 400, the source of near infrared (n-IR) radiation can be, e.g., a n-IR lamp or LED array. Typically, the source of n-IR has a peak emission at wavelengths in the range of from 750 nm to 1400 nm, e.g., at 810 nm. Near IR sources suitable for use in the present invention include those described, e.g., in U.S. Pat. No. 7,820,991, also incorporated herein by reference. Commercially available n-IR dryers include ADPHOS MR dryers, available from Adphos Innovative Technology GmbH. In any event, the aqueous pigment ink 300 deposits are preferentially heated and the substrate 100 should experience a lesser degree of heating. In that way, relatively heat sensitive substrates 100 can be printed and dried at high printing speeds. It also reduces the amount of water that is absorbed by the substrate 100, thereby reducing any deleterious effects such as paper deformation.

As noted above, the printing of aqueous pigment inks 300 comprising anionically stabilized pigments 200 on a substrate 100 having multivalent metal salt present at the surface results in rapid immobilization of the pigments on the surface, essentially forming a separate ink layer on the surface of the substrate 100. In multicolor imaging involving more than a single color pigment ink 300, multiple ink layers are formed on top of one another. Although this produces images with high optical density, large color gamut, and excellent sharpness and resolution, the location of the ink layers on the outermost surface of the printed substrate 100 can make them susceptible to removal by physical stressors, such as scratch, abrasion, and other forms of mechanical force. Therefore, one of the primary objectives of the present invention is to accelerate the improvement in the physical durability of the printed pigment inks 300 on the dried substrate 100. In this context, print durability is defined as the resistance to change or degradation of the printed and dried pigment inks 300 in response to a physical stress factor. Physical stresses can include the intentional or accidental interaction of the print with water or other fluids, subjecting the print to mechanical forces such as friction, tension, flexure, or combinations of the above. Physical stresses are often encountered in between the time the actual print or image is produced and when it is delivered to the end-user. For example, a mail solicitation piece can be subjected to friction, tension, and flexure as the printed web is transported through the converting equipment, folded and inserted into an envelope, and then transported through various pieces of equipment used by the postal system to convey and sort the mail, and, finally during the delivery of the mail, it can be subjected to water in the form of rain, sleet, or snow. Another example of a combination of physical stresses is the application of a highlighter or a wet finger to a trade book or text book, wherein both fluid and friction are simultaneously applied to the printed page. Thus, resistance of the dried, deposited pigment ink 300 to wet and dry abrasive forces is an important print durability attribute for many commercial printing applications.

Yet another aspect of durability of the printed substrate 100 is the ability of the dried, deposited pigment ink 300 along with any applied pre-coatings to strongly adhere to the substrate 100 and to any subsequently deposited layers. Likewise, the ability to apply and remove tape from the printed substrate 100 without damaging or removing the printed pigment ink 300 in the process is another example of print durability. Thus, the resistance of the dried, deposited pigment ink 300 to removal by delamination, whether by adhesive or cohesive failure, is another important attribute for certain printing applications.

It has been found quite unexpectedly that these and other aspects of print durability are rapidly and significantly improved when dried aqueous pigment ink 300 comprising anionically stabilized pigment particles deposited on a substrate 100 having multivalent metal salt present at the surface of the substrate 100 is further processed by applying substantially pure water and heat to the dried substrate 100 with deposited aqueous pigment ink 300. The key element of this durability enhancing process is the remoistening of the dried, printed pigment ink 300 deposits. The application of heat serves to further accelerate the process, and, in certain embodiments, the heat serves to remove any excess moisture at the end of the process and return the substrate 100 to a normal ambient moisture level.

The durability enhancing process is accomplished by using various different techniques such as having a conditioning chamber or oven 500 or a temperature and humidity controlled oven wherein moisture and heat are applied to the dried pigment ink 300 on the substrate 100. The conditioning chamber or oven 500 is preferably in-line with the printing process so that the benefit of the increased durability is achieved prior to the next step in the process. Alternately, the printed sheets or rolls are placed in a conditioning chamber or oven 500 in a separate step. In either event, the preferred temperature of the conditioning chamber or oven 500 is at or above 40° C., and the relative humidity is at or above 50%; more preferably the temperature is at or above 50° C., and the relative humidity is at or above 80%.

Simply raising the temperature at a given ambient relative humidity, such as typically practiced with heat-set offset inks or water based flexographic inks, is insufficient to substantially accelerate the rate of increased durability. Likewise, simply applying moisture to the surface of the printed substrate 100 without subsequently drying the printed substrate 100 back to ambient moisture levels is also insufficient to accelerate an increase in durability of the printed pigment inks 300 on the substrate 100.

In a preferred embodiment, the heat and humidity are applied simultaneously. Although the upper limits to the effective amounts of heat and humidity are not known, the use of a steam chamber or oven 500, sometimes referred to as a "steam foil," which can achieve temperatures at or near 100° C. at essentially 100% relative humidity, is an especially preferred embodiment for accelerating the increase in durability of the dried deposited pigment ink 300 in-line with the printing process.

Another preferred embodiment involves re-moisturizing the dried, printed substrate 100 with a uniform layer of substantially pure liquid water followed by immediate re-drying of the substrate 100. The uniform layer of liquid water is applied by any known way, such as roll coating, pan coating, spraying, misting, indirect flexo coating, and the like. When liquid water is applied to the dried, printed substrate 100 a wet coverage between 0.05 and 40 $g/m^2$ is preferred; a wet coverage between 0.1 and 30 $g/m^2$ is more preferred; even more preferred is a wet coverage between 0.1 and 20 $g/m^2$. When taking re-drying into consideration, a most preferred wet coverage of water is between 0.1 and 1 g/m$^2$. When liquid water is applied to the dried, printed substrate 100, re-drying can be accomplished using ambient heat, for example by drying on a bench top at room temperature overnight.

As noted above, the uniform layer of substantially pure liquid water can contain the usual small amounts coating aids, such as surfactants, biocides, pH adjustors, conductivity modifiers, rheology modifiers, and the like so long as the coverage is uniform and the re-moistened printed substrate 100 is re-dried immediately after the application of the fluid containing liquid water.

In accordance with the present invention, following the application of moisture and heat, the printed substrate 100 is brought back to an equilibrium ambient temperature and moisture content prior to further processing. For paper-based substrates, this is typically in the range of 15° C. to 30° C. and a bulk moisture level between 4% and 8%.

Additional processes can also be applied to the dried, printed substrate 100 subsequent to the application of moisture and heat as described above. Included in such processes are a fusing step, wherein the dried, printed, and conditioned substrate 100 is passed through a pair of rollers at elevated pressures and optionally elevated temperatures. Another process that can be included is the application of an electric field across the substrate 100 in such a way that forces the multivalent metal ions away from the surface of the dried, printed substrate 100.

The following examples illustrate, but do not limit, the utility of the present invention.

EXAMPLES

Example 1

Oven Incubation Studies Comparing Substrates with and without Divalent Metal Salts Utopia Book Matte (UBM), a matte coated paper intended for offset printing of trade and text books, and Utopia Book IJ (UB IJ), a matte coated paper (containing divalent metal ions in the coating) for inkjet printing of trade and text books, both manufactured by Appleton Coated Paper Company, were used for this experiment. A portion of the untreated UBM paper was surface treated as described in Example 6 in U.S. Pat. No. 8,562,126 B1. This surface-treated sample is designated t1-UBM in the following table. Note that in this prior art example, the use of the cross-linked hydrophilic coatings comprising multivalent metal cations imparted significant improvements in print quality, but wet abrasion was still considered unsatisfactory for applications such as text books.

Prints were made on a single color test fixture using a Kodak PROSPER continuous inkjet printhead and an aqueous, anionically stabilized black pigment ink of the type described in US 2007/0043144 A1, and the prints were dried over night on the bench top. To simulate the effect of a wet finger smear, a manual finger rub was carried out using a polynitrile glove that had been dipped into distilled water, and the excess water had been shaken off. A section of black text was then firmly rubbed across an area of the printed text and into an adjacent unprinted area, and the results were visually evaluated and summarized in the following table.

| Example | Paper | Salt Treatment | 1 day ambient | 20 hr, 40° C., 50% RH | 20 hr, 38° C., 80% RH |
|---|---|---|---|---|---|
| 1A (comparative) | UBM | None | 1 | 1 | 0 |
| 1B (inventive) | UB IJ | Mill Treated | 3 | 2 | 1 |
| 1C (inventive) | t1-UBM | Off-line | 4 | 3 | 1 |
| 4 | | | Severe smearing | | |
| 3 | | | Objectionable Smearing | | |
| 2 | | | Noticeable Smearing | | |
| 1 | | | Slight smearing | | |
| 0 | | | No smearing | | |

These results show that when an aqueous anionically stabilized ink is printed onto a substrate where no divalent metal salt is present in the surface of the substrate (UBM), improved durability, as evidenced by a simulated wet finger smear test, is observed at early sample age, and it is hardly improved with incubation at elevated moisture and heat. However, when divalent metal salts are present, either as supplied from the paper mill (UB IJ), or surface treated off-line with a composition comprising a divalent metal salt (t1-UBM), relatively poor durability is observed at early sample age, but the durability is rapidly and substantially improved when the printed and dried sample is incubated at elevated levels of moisture and heat, with higher levels of moisture showing a greater degree of improvement.

Example 2

Oven Incubation Studies Comparing the Effect of Humidity

A solution comprising 4.5% Gohsefimer Z-320 polyvinyl alcohol (Nippon Gohsei), 9.9% anhydrous calcium chloride (Univar), and 5% Polycup172 solution (Ashland) was applied to Sterling Ultra Gloss text paper (NewPage, 80 lb. basis weight) to produce an inkjet receptive coating of about 0.5 g/m$^2$ dry coating weight on the paper surface. The treated paper was then printed on a single color test fixture using a Kodak PROSPER continuous inkjet printhead and an aqueous, anionically stabilized black pigment ink of the type described in US 2007/0043144 A1. The resulting prints were permitted to stand before further testing at the following conditions:

A) at ambient room conditions (23° C./21% relative humidity) for 2 hours;

B) at ambient room conditions (23° C./21% relative humidity) for 24 hours;

C) in a mild oven at 40° C./10% relative humidity for 20 hours before removal and equilibrating at ambient room conditions for another hour;

D) in a mild oven at 60° C./4% relative humidity for 20 hours before removal and equilibrating at ambient room conditions for another hour;

E) at 40° C./50% relative humidity for 20 hours before removal and equilibration at ambient room conditions for another hour; and F) at 38° C./80% relative humidity for 20 hours before removal and equilibration at ambient room conditions for another hour.

The printed samples were tested for resistance to wet abrasion by applying 2 drops distilled water on region of maximum print density and permitting this to stand 20 seconds. This region was then rubbed with 5 back and forth strokes of a double layer of paper toweling (Scott Single-Fold Towels, Kimberly-Clark) under a 100-g brass weight. The optical density of the print region within the water droplets was then measured and compared to the optical density of the same print prior to wet abrasion testing. The calculated percent density lost after the wet abrasion test is the metric used to characterize resistance to wet abrasion (less percent density loss is better). The results are summarized in following table.

| Example | Treatment | No abrasion density | Wet abrasion density | Wet abrasion % density loss |
|---|---|---|---|---|
| 2A (comp,) | 2 hrs ambient (23° C./21% RH) | 1.877 | 1.27 | 32.5% |
| 2B (comp.) | 24 hrs ambient (23° C./21% RH) | 1.867 | 1.56 | 16.4% |
| 2C (comp.) | 20 hrs @ 40° C./10% RH | 1.870 | 1.44 | 23.0% |
| 2D (comp.) | 20 hrs @ 60° C./4% RH | 1.857 | 1.42 | 23.7% |
| 2E (inv.) | 20 hrs @ 40° C./50% RH | 1.863 | 1.83 | 1.8% |
| 2F (inv.) | 20 hrs @ 38° C./80% RH | 1.860 | 1.90 | −2.3% |

Note that resistance to wet abrasion is improved slowly with time or when kept at ambient conditions over night or incubated in a dry oven (Examples 2B, 2C, 2D vs 2A), but that prints kept at elevated humidity (Examples 2E and 2F vs 2C) show much improved wet abrasion resistance over the same period of time.

Example 3

Application of Liquid Water Followed by Immediate Re-Drying

Two types of papers were used for this experiment: Sterling Ultra Gloss (SUG), a glossy coated paper intended for offset printing manufactured by NewPage Paper Company, and Utopia Book Matte (UBM), a matte coated paper intended for offset printing, manufactured by Appleton Coated Paper Company. In this experiment, a comparison was made between commercial coated papers with and without a surface coating comprising a cross-linked hydrophilic polymer and divalent metal salt of the type described in Example 5 in US 2011/0279554 (t1-SUG) and Example 6 in U.S. Pat. No. 8,562,126 B1 (t1-UMB). Note again that in these prior art examples, the use of the cross-linked hydrophilic coatings comprising multivalent metal cations imparted significant improvements in print quality, but wet abrasion was still considered unsatisfactory for applications such as text books.

Prints were made on a single color test fixture using a Kodak PROSPER continuous inkjet printhead and an aqueous, anionically stabilized black pigment ink of the type described in US 2007/0043144 A1. After the prints were dried, an air brush with was used to spray distilled water over a region of black text. Enough water was applied to saturate the surface, and then the water-treated samples were immediately re-dried under ambient conditions. To simulate the effect of a wet finger smear, a manual finger rub was carried out using a polynitrile glove that had been dipped into distilled water, and the excess water had been shaken off. A section of black text was then firmly rubbed across an area of the printed text and into an adjacent unprinted area, and the results were visually evaluated and summarized in the following table.

| Example | Description | Re-Moisturize After Printing | Print Quality | Wet Finger Smear |
|---|---|---|---|---|
| 3A | SUG | No | Poor | None |
| 3B | SUG | Yes | Poor | None |
| 3C | t1-SUG | No | Excellent | Noticeable |
| 3D | t1-SUG | Yes | Excellent | Slight |
| 3E | UBM | No | Poor | Slight |
| 3F | UBM | Yes | Poor | Slight |
| 3G | t1-UBM | No | Excellent | Noticeable |
| 3H | t1-UBM | Yes | Excellent | Slight |

These results show that when an aqueous anionically stabilized ink is printed onto a substrate where no divalent metal salt is present in the surface of the substrate (SUG or UBM), acceptable initial wet smear resistance is observed and is not further improved by the application of liquid water to the dried print samples. These results also once again demonstrate that after printing and drying of the papers that had been pre-coated with the divalent metal salts, the added steps of re-moisturization and re-drying results in much improved wet finger smear resistance.

Example 4

Application of Liquid Water or Steam Followed by Immediate Re-Drying—Impact on Wet Finger Smear of 100% Tint Color Density Patches For this experiment, a web of t1-UMB as described in Example 3 was printed and dried on a on a Kodak PROSPER press using cyan, magenta, yellow, and black pigment inks. These inks are anionically dispersed using dispersant polymers of the type described in US 2007/0043144 A1. Re-moisturizing at 5 g/m$^2$ water was accomplished using the drawdown method. Higher wet coverages were accomplished by adjusting the spray rate of a water filled air brush. Steam was sprayed on to the print using a ST-1361 portable steamer by Bogue Systems. Two pulses of steam were applied. In all of the above re-moisturizing steps the surface of print was visually saturated with water. The prints were then immediately dried by placing the re-moisturized print in a Smart system 5 Microwave Moisture Analyzer from CEM Corporation.

The same manual wet finger smear test was performed as described in Example 2. This was done in areas without and without the re-moisturizing/re-drying step. The corresponding smear densities in unprinted areas are called S1 and S2.

$$\% \text{ Reduction in smear density} = (S1 - S2)/S1 \times 100$$

A 100% reduction means that the print no longer smears.

The following table shows that in all cases the re-moisturizing and re-drying step improved wet finger smear resistance of the color patches.

| Example | Color Patch on t1-UMB | Re-moisturizing Step after Printing | Microwave Re-drying | Reduction in Smear Density |
|---|---|---|---|---|
| 4A | Cyan | Water (~5 gsm) | 1 min | 37% |
| 4B | Cyan | Water (~9 gsm) | 1 min | 29% |
| 4C | Cyan | Water (~16 gsm) | 1 min | 64% |
| 4D | Cyan | Water (~30 gsm) | 1 min | 58% |
| 4E | Magenta | Water (~30 gsm) | 1 min | 63% |
| 4F | Yellow | Water (~30 gsm) | 1 min | 71% |
| 4G | Black | Water (~30 gsm) | 1 min | 39% |
| 4H | Cyan | Steam | 1 min | 75% |

Example 5

Application of Liquid Water or Steam Followed by Immediate Re-Drying—Impact on Wet Abrasion of 100% Tint Magenta Density Patches In this experiment an inkjet receiver was prepared similar to that described in US 2011/0279554. However, the Raycat 56 latex was removed. The parts of dry active ingredients were 63.9 parts $CaCl_2$, 28.1 parts Z320 PVA-acac, 4.2 parts Polycup 172, and 3.8 parts Lanco 1796 wax. The aqueous composition was coated on to 25.5 inch wide web of SUG at 250 feet/min using a reverse gravure cylinder applicator and dried in a mid IR drier to give a paper surface exit temperature of 200° F. (93° C.). Dry coverage was measured gravimetrically to be 0.72 g/m$^2$. The reverse gravure coater was a Kodak Image Optimizer System in-line with a Kodak PROSPER press using aqueous, anionically stabilized pigment inks as described in Example 4. Re-moisturizing was accomplished as described in Example 4. The prints were then immediately air dried or dried using a KL100 Infrared (IR) Emitter Module available from Heraeus Noblelight, Inc.

To simulate the effect of a customer cleanup with a paper towel, a drop of water was placed in the center of a one inch square magenta color patch (100% tint). After 10 seconds a 0.5 by 1 inch weight (24.3 grams) wrapped with a double thickness Kimtech Kimwipe was placed over the patch and rubbed with three strokes. The % density retention was calculated. 100% density retention means that there is no loss of density upon wet abrasion.

% Density Retention=100×(Density after wet rub/Initial density)

The following table shows that re-moisturizing and re-drying steps improved the density retention against under the wet abrasion test. This process can achieve wet abrasion resistance equal to oven incubation of the print for 24 hours at 40° C./50% RH. Note that exposure to heat only provides no wet abrasion benefit.

| Example | Re-moisturizing Step after Printing | Re-drying Step | % Density Retention of Magenta on t2-SUG) |
|---|---|---|---|
| 5A (Control) | None | — | 21% |
| 5B (Comparative) | None | IR - 1.2 min | 12% |
| 5C | Water ~30 g/m$^2$ | Air 45 min | 40% |
| 5D | Steam | Air 45 min | 34% |
| 5E | Water ~30 g/m$^2$ | IR - 0.4 min | 44% |
| 5F | Steam | IR - 0.4 min | 40% |
| 5G | Water ~30 g/m$^2$ | IR - 1.2 min | 61% |
| 5H | Steam | IR - 1.2 min | 66% |
| 5I | Oven at 40° C./50% RH | | 63% |

Example 6

Effect of Incubation at Elevated Temperature and Humidity on Ink Adhesion to PE-Coated Paper as Measured by a Tape Test Sheets of polyethylene-coated paper, such as commonly used for beverage containers or paper cups, were hand-coated with a layer containing 5 parts by weight of a cross-linked hydrophilic polymer and 2 parts by weight of calcium chloride, at a dry coating weight of 0.75 g/m$^2$. The hand-coated sheets were printed on a 4-color test fixture using Kodak PROSPER continuous inkjet printheads and aqueous, anionically stabilized pigment inks. The printed sheets were air dried. One sheet was kept under ambient lab conditions for 24 hours (reference), a second sheet was incubated in a chamber at 40° C. and 50% relative humidity for 24 hours (invention), and a third sheet was incubated at 50° C. and 85% relative humidity for 24 hours (invention).

Each of these samples was then subjected to a tape adhesion test which is designed to assess both the adhesion of the ink to the substrate as well as the cohesive strength of the inks. A 63.5 mm by 12.7 mm strip of Scotch Transparent Tape, Cat. 600, (3M Corporation), was applied to a test print resting on a solid counter top using 4-6 passes of firm pressure applied to the tape with one's thumb in a white cotton glove. The tape was then peeled slowly away from the specimen over 6-8 seconds at a 90° angle. Both the tape and print surface were then visually inspected for evidence of transfer of ink from the print surface to the tape, and the results were ranked using the following 1-5 scale:

1 No ink transferred

2 Just noticeable amount of ink transferred to tape

3 Moderate amount of ink transferred to tape, but most left on print

4 Significant amounts of ink transferred to tape

5 Severe damage, with areas of complete ink transferred to tape

The results are summarized in the following table.

| Example | Treatment | Tape Adhesion Result |
|---|---|---|
| 6A (reference) | Ambient lab | 3.5 |
| 6B (inventive) | 40° C./50% RH | 3.0 |
| 6C (inventive) | 50° C./85% RH | 1.0 |

These results show that incubation of the printed and dried samples at increasing levels of temperature and humidity produces corresponding increases in tape adhesion durability, with the sample incubated at 50° C. and 85% relative humidity for 24 hours showing no removal of ink.

This invention has been described in detail with particular reference to certain preferred embodiments thereof, but it will be understood that variations and modification can be effected within the spirit and scope of the invention.

PARTS LIST

100 substrate
200 inkjet deposition system
300 pigment ink
400 drying system
500 chamber or oven

The invention claimed is:

1. A method for improving durability of aqueous ink deposited on a substrate having multivalent metal salt present at a surface of the substrate, the method comprising, in order:

depositing an aqueous ink on the surface of the substrate, wherein the aqueous ink is an anionically stabilized pigment ink;

drying the substrate having the deposited aqueous ink to substantially remove the water from the deposited aqueous ink;

applying substantially pure water and heat to the dried substrate having the deposited aqueous ink; and removing the applied water and heat to return the dried substrate having the deposited aqueous ink to an ambient temperature and moisture content, the applied moisture and heat being sufficient to cause a significant improvement of the durability of the deposited aqueous ink on the surface of the dried substrate.

2. The method of claim 1, wherein the applying step includes providing a layer of substantially pure liquid water over the dried substrate having the deposited aqueous ink and simultaneously or subsequently re-drying the substrate.

3. The method of claim 2, wherein the layer of substantially pure liquid water applied at a wet coverage of between 0.05 and 40 $g/m^2$.

4. The method of claim 1, wherein the applying step further includes transporting the dried substrate having the deposited aqueous ink into a chamber which is adapted to provide the substantially pure water and the heat to the dried substrate having the deposited aqueous ink.

5. The method of claim 4, wherein the chamber is an oven and the substantially pure water is applied to the dried substrate having the deposited aqueous ink by increasing the relative humidity inside the oven.

6. The method of claim 4, wherein the chamber is in line with the aqueous ink depositing and drying steps.

7. The method of claim 6, wherein the substantially pure water is applied in the chamber in the form of steam across the dried substrate having the deposited aqueous ink.

8. The method of claim 1, wherein the anionically stabilized pigment ink includes a pigment dispersant comprising an anionic surfactant or an anionic polymer.

9. The method of claim 1, wherein the anionically stabilized pigment ink includes a self-dispersed pigment with anionic surface charge.

10. The method of claim 8, wherein the pigment dispersant is an anionic polymer comprising carboxylate functionality.

11. The method of claim 1, wherein the anionically stabilized pigment ink further includes a polyurethane additive.

12. The method of claim 1, wherein the multivalent salt includes a cation selected from $Mg^{+2}$, $Ca^{+2}$, $Ba^{+2}$, $Zn^{+2}$, and $Al^{+3}$.

13. The method of claim 1, wherein the multivalent salt includes calcium chloride, calcium acetate, calcium nitrate, magnesium chloride, magnesium acetate, magnesium nitrate, or hydrated versions of these salts.

14. The method of claim 1, wherein the substrate includes paper, film, or composites.

15. The method of claim 1, wherein the applied heat is in the range of 20° C. to 100° C.

16. The method of claim 1, wherein the applied substantially pure water is the form of vapor in the range of 50% to 100% relative humidity.

17. The method of claim 1, further comprising, subsequently to applying the substantially pure water and heat to the dried substrate having the deposited aqueous ink, passing the dried substrate having the deposited aqueous ink through a pair of rollers at elevated pressures and optionally elevated temperatures.

18. The method of claim 1, further comprising, subsequently to applying the substantially pure water and heat to the dried substrate having the deposited aqueous ink, applying an electric field across the dried substrate having the deposited aqueous ink sufficient to drive the multivalent metal ions away from the surface of the dried substrate having the deposited aqueous ink.

* * * * *